US009085178B2

(12) United States Patent
Endo

(10) Patent No.: US 9,085,178 B2
(45) Date of Patent: Jul. 21, 2015

(54) PRINTING APPARATUS

(71) Applicant: SEIKO EPSON CORPORATION, Tokyo (JP)

(72) Inventor: Tsunenobu Endo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/148,070

(22) Filed: Jan. 6, 2014

(65) Prior Publication Data

US 2014/0192109 A1 Jul. 10, 2014

(30) Foreign Application Priority Data

Jan. 7, 2013 (JP) ..... 2013-000373
Dec. 26, 2013 (JP) ..... 2013-268712

(51) Int. Cl.
*B41J 29/38* (2006.01)
*B41J 29/393* (2006.01)
*B41J 11/00* (2006.01)

(52) U.S. Cl.
CPC ..... *B41J 11/0095* (2013.01)

(58) Field of Classification Search
CPC ..... B41J 29/393; B41J 11/0095; B41J 11/009
USPC ..... 347/14, 16, 19
See application file for complete search history.

(56) References Cited

U.S. PATENT DOCUMENTS

2005/0229843 A1 10/2005 Nishi et al.
2006/0177256 A1 8/2006 Buck et al.
2007/0076040 A1 4/2007 Shang et al.
2009/0189939 A1 * 7/2009 Enda et al. ..... 347/14
2011/0116813 A1 5/2011 Okamoto et al.

FOREIGN PATENT DOCUMENTS

| | | |
|---|---|---|
| JP | 04-341444 | 11/1992 |
| JP | 05-262019 | 10/1993 |
| JP | 06-229787 | 8/1994 |
| JP | 10-217444 | 8/1998 |
| JP | 11-165406 | 6/1999 |
| JP | 2000-025987 | 1/2000 |
| JP | 2002-036525 | 2/2002 |
| JP | 2003-066744 | 3/2003 |
| JP | 2004-188956 | 7/2004 |
| JP | 2005-255308 | 9/2005 |
| JP | 2006-168138 | 6/2006 |

(Continued)

*Primary Examiner* — Jannelle M Lebron
(74) *Attorney, Agent, or Firm* — Workman Nydegger

(57) ABSTRACT

A printing apparatus includes a print head that forms an image on a target printing surface of a printing medium by relatively moving with respect to the printing medium, an elastic wave radiation unit that radiates elastic waves, in air toward the target printing surface, a reception unit that receives the elastic waves that are radiated from the elastic wave radiation unit and reflected by the target printing surface, and a control unit which measures the time of arrival taken for elastic waves, and stops relative movement when the time of arrival is shorter than a defined time, in which the defined time is a time of arrival in which a distance from the print head to the printing medium and the distance from the elastic wave radiation unit to the printing medium to an allowable minimum distance between the print head and the printing medium.

5 Claims, 4 Drawing Sheets

(56) References Cited

FOREIGN PATENT DOCUMENTS

| | | |
|---|---|---|
| JP | 2006-219300 | 8/2006 |
| JP | 2007-144397 | 6/2007 |
| JP | 2007-163642 | 6/2007 |
| JP | 2009-001374 | 1/2009 |
| JP | 2010-143657 | 7/2010 |
| JP | 2011-107342 | 6/2011 |
| JP | 2011-126656 | 6/2011 |

* cited by examiner

FULL WAVE RECTIFYING DETECTION

HALF WAVE RECTIFYING DETECTION

PRINTING APPARATUS

BACKGROUND

1. Technical Field

The present invention relates to a printing apparatus that forms an image by relatively moving a carriage along a target printing surface of a printing medium.

2. Related Art

Ink jet type printing apparatuses are well-known as a representative example of this type of printing apparatus. In these types of printing apparatus, ink droplets are discharged onto a surface of a printing medium while moving in a transport direction of a printing medium, a main scanning direction that intersects a so-called sub-scanning direction, in a state in which a carriage that is mounted with a printing means becomes separated from a surface of the printing medium (target printing surface) from above, and the printing medium is sequentially transported in the sub-scanning direction. In this manner, an image is printed on the printing medium.

In this type of printing apparatus, there are cases in which creases in a printing medium, which are caused by shifts in transport during the transport of the printing medium, occur. In addition, there are cases in which waves, so-called cockling, are generated in the printing medium by stretching and the like that results from ink absorption and the temperature and humidity of the printing medium. If this phenomenon occurs, the printing medium is partially lifted up, and there are cases in which the carriage rubs against or impacts with the surface of the printing medium during a printing operation.

In order to deal with this problem, a technology which is provided with a sensor that detects uplift of the printing medium in the vicinity of the carriage, and in which movement of the carriage is stopped when uplift is detected, has been considered. For example, in JP-A-5-262019, a technology in which changes in a gap between a recording head and a target recording material are detected by an optical detection type sensor, and the movement of the recording head is stopped in cases in which the amount of change differs from a defined amount, is disclosed.

The configuration of the optical detection type sensor is not specifically disclosed in JP-A-5-262019, but for example, the optical detection type sensor that is disclosed in JP-A-2006-168138 is an example of technology that can be used for such an application. In the technology that is disclosed in JP-A-2006-168138, light is caused to be incident to a target recording medium from an oblique direction, and the surface height of the target recording medium is determined by detecting the position at which specular reflected light from the target recording medium is the strongest.

In a configuration in which the height directional positioning of a printing medium is detected optically in this manner, there are causes of false detections such as the direction of specular reflected light changing as a result of inclinations in the surface of the printing medium that occur due to uplift thereof, or detection not being performed for transparent printing media which causes light to pass through. Therefore, there is a concern that it may be possible to completely avoid impacts between the carriage and the printing medium due to the false detection of positions, and that the action of the apparatus may be stopped even though there is a state in which impacts have not occurred.

SUMMARY

An advantage of some aspects of the invention is that a technology that solves the abovementioned problems and is effective in preventing impact between a carriage and a printing medium is provided in a printing apparatus that forms an image by relatively moving a carriage along a target printing surface of a printing medium.

According to an aspect of the present invention, there is provided a printing apparatus that includes a carriage printing unit that forms an image on a target printing surface of a printing medium by relatively moving with respect to the printing medium, an elastic wave radiation unit that radiates elastic waves, which are pulses or burst waves in which a radiation direction is defined, toward the target printing surface, a reception unit that receives the elastic waves that are radiated from the elastic wave radiation unit and reflected by the target printing surface, and a control unit which measures the time of arrival taken for elastic waves that are radiated from the elastic wave radiation unit to arrive at the reception unit, and stops relative movement when the time of arrival is shorter than a defined time, in which the defined time is a time of arrival in which a distance that is obtained by adding a difference in the distance from the printing unit to the printing medium and the distance from the elastic wave radiation unit to the printing medium to an allowable minimum distance between the printing unit and the printing medium that is established in advance, is equivalent to a distance from the elastic wave radiation unit to the printing medium.

In this kind of configuration, elastic waves are radiated toward the printing medium, and reflected waves from the target printing surface of the printing medium are received. In the detection of distance on the basis of the time of arrival of the elastic waves, the influence of the inclination of a reflection surface is small, and in addition, detection is possible even if a physical object is transparent. In addition, by stopping the relative movement of the printing unit and the printing medium when the time of arrival is shorter than a defined time that corresponds to the allowable minimum distance, it is possible to promptly stop relative movement when the distance between the printing unit and the printing medium has become shorter than the allowable minimum distance. As a result of this configuration, impact of the printing unit and the printing medium can be avoided. On the other hand, it is possible to perform image formation without relative movement being stopped if the distance between the printing unit and the printing medium is greater than the allowable minimum distance.

In this case, for example, when an angle that is formed by a central axis of the radiation direction of the elastic waves from the elastic wave radiation unit, and a normal line of the target printing surface at an intersection point of the central axis and the target printing surface at the time of image formation, is expressed using the symbol θ, the allowable minimum distance is expressed using the symbol Dmin, and an acoustic velocity in air is expressed by the symbol Vs, a frequency Fs of the elastic waves may satisfy the following formula:

$$Fs \geq (Vs \cdot \cos\theta)/(2D\min)$$

In this type of printing apparatus, it is normal for the distance between the carriage and the printing medium to be from a few millimeters to a few centimeters. On the other hand, since the wavelength of elastic waves in air is similar to this, it is necessary to suitably set the frequency of the elastic waves in order to obtain resolution needed in order to detect such a distance. This will be explained in more detail later, but the abovementioned relational expression is an efficient indicator that shows the conditions to obtain the sufficient detection resolution needed in order to avoid impact.

In addition, for example, a configuration in which, in a pathway of the elastic waves from the elastic wave radiation unit to reach the reception unit after passing the target printing surface, the pathway length to the reception unit after passing the target printing surface is shorter than the pathway length to the target printing surface from the elastic wave radiation unit, may be used. By using such a configuration, it is possible to suppress reductions in the accuracy of detection that result from inclination of a reflection direction and scattering of reflected waves.

In addition, for example, the elastic wave radiation unit and the reception unit may be acoustically insulated. In the manner described above, since a pathway of the elastic waves from radiation to the reception unit is short, and reflected waves reach the reception unit in an extremely short amount of time, for example, if vibrations from the elastic wave radiation unit filter through a case or a support member and are directly transferred to the reception unit, it is difficult to separate the vibrations from reflected waves. It is preferable to acoustically insulate the elastic wave radiation unit and the reception unit in order to suppress such throughput of vibrations.

In addition, for example, the printing apparatus may further include an envelope curve wave detection unit that outputs a signal that corresponds to an envelope curve of a waveform of a received elastic wave that is received by the reception unit, and the control unit may set a time from when the elastic wave radiation unit radiates elastic waves to when an output signal of the envelope curve wave detection unit reaches a predetermined threshold value as the time of arrival. The waveforms of the elastic waves, which are radiated as pulse waves or burst waves, are deformed by scattering or by resonance and reverberation from the surrounding members until the waveforms reach the reception unit. In the objective of measuring the time of arrival, it is not necessary to reproduce the waveform, and using envelope curve wave detection, it is possible to sufficiently achieve the objective with such collapsed waveforms. In addition, by suitably setting the threshold value at that time, it is possible to perform measurement without receiving the influence of noise.

In this case, the envelope curve wave detection unit may further generate the signal through full-wave rectification and smoothing of the received elastic wave, and a time constant $\tau$ of smoothing may have the following relationship with respect to the frequency Fs of the elastic waves:

$$\tau \geq 1/(2\pi \cdot Fs).$$

This smoothing condition is a condition that generates so-called diagonal clipping distortion, but in the objective of measuring the time of arrival, in addition to increasing detection sensitivity, this type of distortion is useful. In addition, in half-wave rectification, the resolution of the detection distance is a length that corresponds to the wavelength of the elastic waves, but if full-wave rectification is used, it is possible to obtain a resolution of a length that corresponds to a half wavelength.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
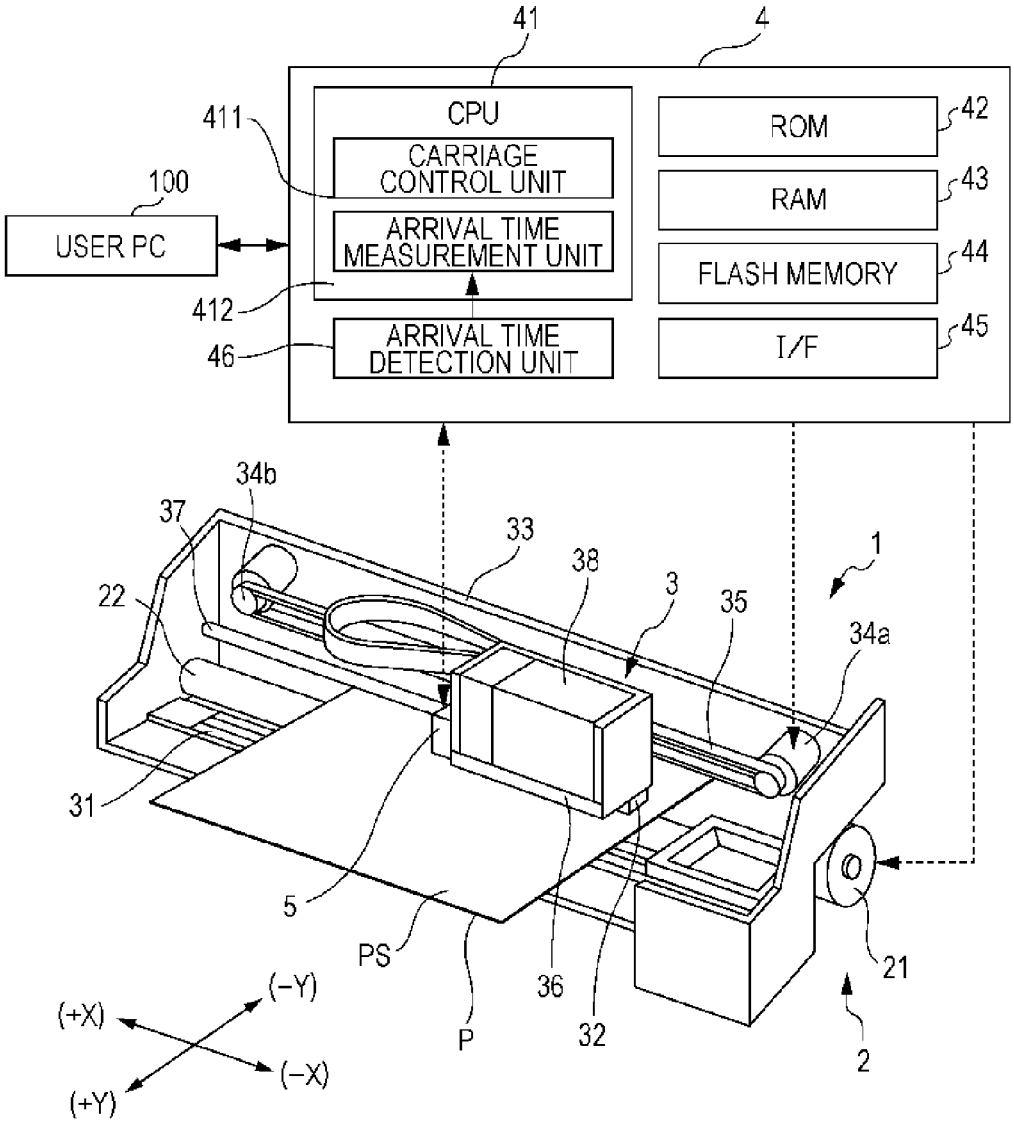
FIG. 1 is a view that shows an embodiment of a printing apparatus according to the present invention.

FIG. 1 is a view that shows an outline of a configuration of an ink jet printer that is an embodiment of a printing apparatus according to the present invention. The ink jet printer 1 is an apparatus that prints images, characters or the like on a surface of a printing medium P such as regular paper, coated paper or film on the basis of print data that has been sent from a user personal computer (hereinafter referred to as a "user pc") 100 that is configured as a well-known general-purpose computer. As shown in FIG. 1, the ink jet printer 1 is provided with a paper delivery mechanism 2 that transports a printing medium P in a transport direction, that is a sub-scanning direction Y, by driving a paper delivery roller 22 with a printing medium delivery motor 21, a printing mechanism 3 that performs printing by discharging ink droplets onto a surface of a printing medium P that has been transported onto a platen 31 by the paper delivery mechanism 2 from a print head 32, and a controller 4 that controls the entire ink jet printer 1.

The printing mechanism 3 is provided with a carriage motor 34*a* that is disposed at one end (the left-hand side of FIG. 1) of a mechanical frame 33 and a driven roller 34*b* that is disposed at the other end (the right-hand side of FIG. 1) of the mechanical frame 33. Further, a carriage belt 35 is provided in a hanging manner between the carriage motor 34*a* and the driven roller 34*b*. A carriage 36 is connected to a portion of the carriage belt 35. Therefore, when the carriage motor 34*a* is operated on the basis of operation instructions from the controller 4 the carriage 36 reciprocates along a carriage axis 37 in a main scanning direction (the left and right direction in FIG. 1) X. Furthermore, a linear encoder (not shown in the drawings) that outputs a pulse-shaped signal that accompanies the movement of the carriage 36 to the controller 4 is disposed on the rear surface of the carriage 36, and the controller 4 manages the position of the carriage 36 in the main scanning direction X on the basis of the signal from the linear encoder.

A print head 32, ink cartridges 38 and an ultrasonic wave sensor 5 are installed in the carriage 36, and these components move integrally with the carriage 36 in the main scanning direction X. The ink cartridges 38 each contain the colors of ink of CMYK of cyan (C), magenta (M), yellow (Y) and black (K) that contain dyes or pigments as coloring agents in water as a solvent. Further, the print head 32 receives a supply of ink from the ink cartridges 38 and discharges ink droplets.

The ultrasonic wave sensor 5 is attached to a lateral surface of the (+X) direction side of the carriage 36, and the outputs a signal that is associated with the distance from the print head 32 to the printing medium P on the platen 31 to the controller 4. This will be explained in more detail later, but the ultrasonic wave sensor 5 receives reflected waves from the surface of the printing medium P in addition to radiating pulse-wave or burst-wave ultrasonic waves (elastic waves) toward the printing medium P. A time (hereinafter called a "time of arrival") from when the elastic waves are radiated from the ultrasonic wave sensor 5 and reflected by the printing medium P, to when the elastic waves reach the ultrasonic wave sensor 5 again and are received is information that indirectly expresses the distance to the printing medium P. That is, the greater the distance to the printing medium P, the longer the time of arrival will be, and if the distance is short, the time of arrival will also be short.

As shown in FIG. 1, the controller 4 is configured as a microprocessor centered around a CPU (Central Processing Unit) 41, and other than the CPU 41, is provided with a ROM (Read Only Memory) 42 that stores programs for various processes, a RAM (Random Access Memory) 43 that temporarily stores data, flash memory 44 to and from which data can be written and deleted, an interface (I/F) 45 that performs the exchange of information with external devices and an input/output port (not shown in the drawings). A printing buffer region is provided in the RAM 43, and print data that has been delivered from the user pc 100 via the interface (I/F) 45 is stored in the printing buffer region. Further, the CPU 41 reciprocates the carriage 36 in the main scanning direction X by outputting a drive signal to the carriage motor 34*a* each time the printing medium P is transported sequentially in the sub-scanning direction Y by outputting a drive signal to the printing medium delivery motor 21. In addition, the CPU 41 discharges ink droplets from the print head 32 by applying a drive signal to the print head 32 in correspondence with the transport of the printing medium P and the reciprocation of the carriage 36. As a result of this configuration, images, characters and the like that correspond to the print data are printed on a surface PS of the printing medium P, that is, a target printing surface.

Furthermore, a time of arrival detection unit 46 for detecting the time of arrival of the elastic waves that performs the exchange of various signals with the ultrasonic wave sensor 5 is provided in the controller 4. The configuration of the time of arrival detection unit 46 will be described later. Various functional blocks, that is, a carriage control unit 411 and a time of arrival measurement unit 412 are realized in the CPU 41 by executing process programs that are stored in the ROM 42 in advance. The time of arrival measurement unit 412 measures the abovementioned time of arrival of the elastic waves on the basis of the signals that are applied thereto from the time of arrival detection unit 46. The carriage control unit 411 controls the movement of the carriage 36 in the main scanning direction, but rapidly stops the carriage 36 when it is detected that the time of arrival that is measured by the time of arrival measurement unit 412 is shorter than a defined time that is set in advance. As will be described later, this configuration prevents the printing medium P from being lifted up from the platen 31 and touching the bottom surface or the lateral surface of the print head 32.

Figure 2:
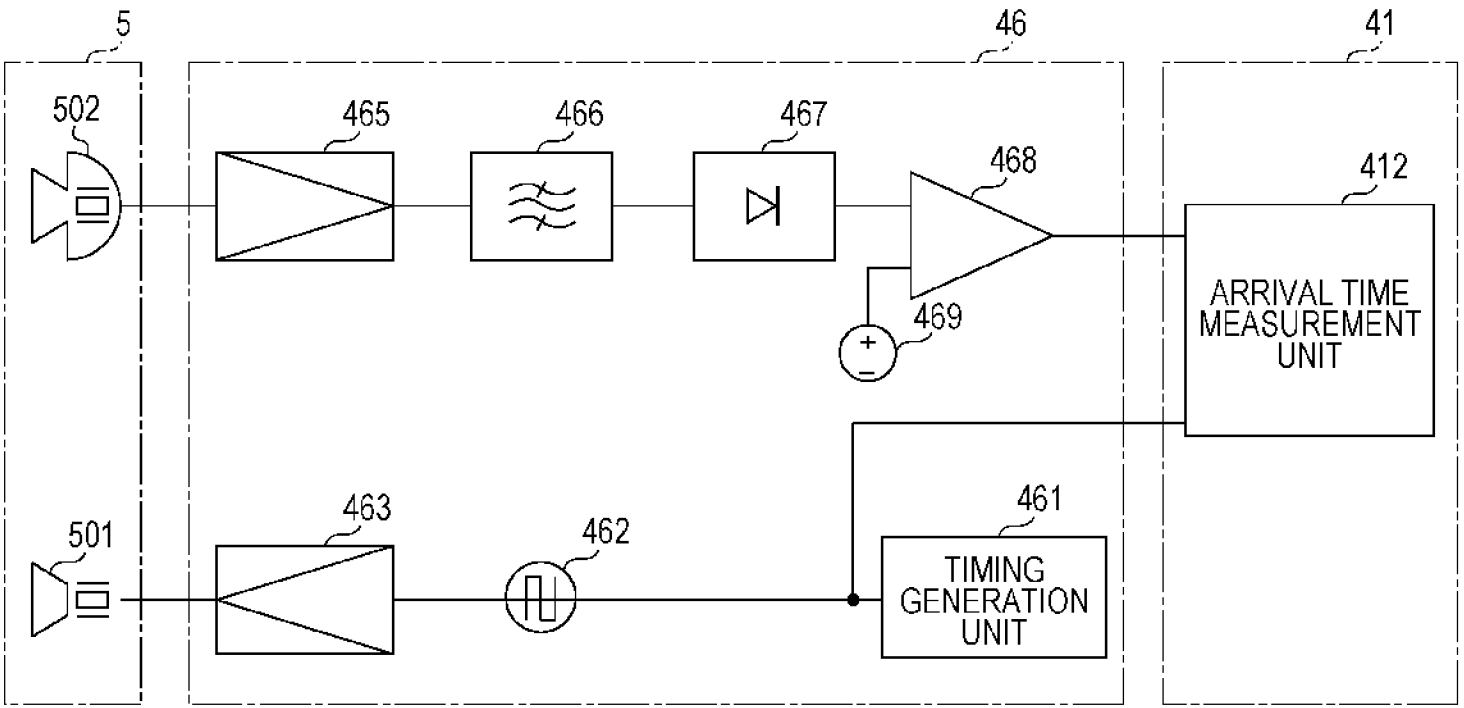
FIG. 2 is a block diagram that shows a configuration of a time of arrival detection unit.

FIG. 2 is a block diagram that shows a configuration of a time of arrival detection unit. The time of arrival detection unit 46 is a functional block for performing the detection of the abovementioned time of arrival by controlling the ultrasonic wave sensor 5, and may be realized by hardware that uses various circuit elements or may be realized as software using a process program that the CPU 41 executes.

The time of arrival detection unit 46 includes a timing generation unit 461 that controls the timing of the generation of the elastic waves, an ultrasonic wave pulse generation unit 462 that generates a pulse-shaped ultrasonic wave signal on the basis of a timing control signal from the timing generation unit 461, and an amplifier 453 that amplifies the pulse-shaped ultrasonic wave signal. The amplified pulse-shaped ultrasonic wave signal is applied to an ultrasonic wave transmitter (the elastic wave radiation unit) 501 that is provided in the ultrasonic wave sensor 5. As a result of this configuration, the elastic waves from the ultrasonic wave sensor 5 are output.

In addition, the time of arrival detection unit 46 is provided with an amplifier 465 that amplifies a signal that is output from an ultrasonic wave receiver (elastic waves reception unit) 502 of the ultrasonic wave sensor 5, a band-pass filter (BPF) 466 that extracts a predetermined frequency range from the amplified signal, a detection unit 467 that performs full-wave rectification wave detection of a signal after filtering, and a comparator 468 that compares an output from the detection unit 467 and a constant voltage value that is output from a threshold value voltage generation unit 469. The comparator 468 outputs a predetermined signal when the output voltage from the detection unit 467 exceeds the output voltage from the threshold value voltage generation unit 469, that is, when the level of the ultrasonic waves (elastic waves) that are received by the ultrasonic wave receiver 502 exceeds a predetermined value.

The output signal from the comparator 468 and the timing control signal from the timing generation unit 461 are input into the time of arrival measurement unit 412 of the CPU 41. The time of arrival measurement unit 412 can ascertain the time of the initiation of the radiation of the elastic waves from the ultrasonic wave sensor 5 from the timing control signal from the timing generation unit 461, and can ascertain the time of the arrival of the elastic waves at the ultrasonic wave sensor 5 from the output signal from the comparator 468. From this information, it is possible for the time of arrival measurement unit 412 to measure the time from when elastic waves radiated from the ultrasonic wave sensor 5 are reflected by the printing medium P to when the elastic waves are received by the ultrasonic wave sensor 5, that is the time of arrival.

Figure 3:
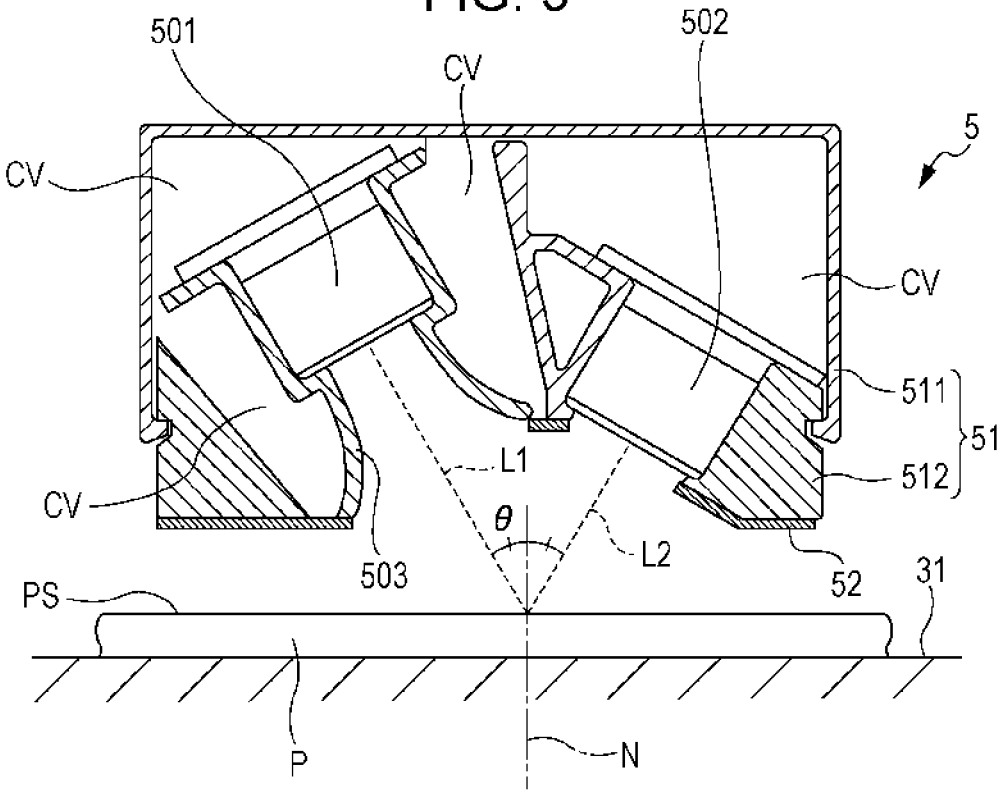
FIG. 3 is a side cross-sectional view that shows an internal configuration of an ultrasonic wave sensor.

FIG. 3 is a side cross-sectional view that shows an internal configuration of an ultrasonic wave sensor. The ultrasonic wave sensor 5 includes a housing 51 in which a box-shaped upper member 511, the bottom surface of which is open, and a lower member 512 that is fitted into the inside of the upper member 511, are combined. The ultrasonic wave transmitter 501 and the ultrasonic wave receiver 502 are provided in the housing 51, but of these components, a horn 503 that limits the radiation direction of the elastic waves is attached to the ultrasonic wave transmitter 501. While the ultrasonic wave receiver 502 is directly fixed to the housing 51, the horn 503 that is integrally formed with the ultrasonic wave transmitter 501 is for example, is attached to the housing 51 through a cushioning material such as urethane foam or flexible rubber. As a result of this configuration, the ultrasonic wave transmitter 501 and the horn 503 that is integrally formed therewith are acoustically insulated from the ultrasonic wave receiver 502. As a result of this configuration, the escape (crosstalk) of elastic waves from the ultrasonic wave transmitter 501 to the ultrasonic wave receiver 502 due to individual propagation in the housing 51 is suppressed.

Further, in addition to acoustic insulators being inserted into cavities CV as appropriate, voids that are arranged in each part of the inside of the housing 51, an acoustic absorbent 52 is affixed to the bottom surface of the housing 51. As a result of this configuration, crosstalk of the elastic waves through air is suppressed. Additionally, since crosstalk from the ultrasonic wave transmitter 501 to the ultrasonic wave receiver 502 occurs through signal cables, it is necessary to take measures to against crosstalk in the hardness and wiring of the cables. More specifically, it is preferable to use cables that are as soft as possible, and to separate wave delivery side from the wave receiving side without bundling the cables together.

A main surface direction of a vibration plate of the ultrasonic wave transmitter 501 and a central axis direction of the horn 503 are substantially the same, and this axis forms the central axis of the direction of progression of the wave surface of the elastic waves, that is, the radiation direction. The degree of the angle between the direction of a normal line N of the surface PS of a printing medium P on the platen 31 and the central axis of the radiation direction is expressed using the symbol θ. In order to increase the reception sensitivity waves reflected directly from the printing medium P, the ultrasonic wave receiver 502 is disposed so that an angle of view of the printing medium surface PS forms the angular degree θ with respect to the same normal line N.

In addition, a pathway length to the ultrasonic wave receiver 502 from the printing medium surface PS, that is, a distance L2 along the pathway from the printing medium surface PS to a wave reception surface of the ultrasonic wave receiver 502 is shorter than a pathway length of the elastic waves to the printing medium surface PS from the ultrasonic wave transmitter 501, that is, a distance L1 along the pathway from the vibration plate of the ultrasonic wave transmitter 501 to the printing medium surface PS. In other words, the ultrasonic wave receiver 502 is installed in a position that is closer to the printing medium P than the ultrasonic wave transmitter 501.

The direction of elastic waves that are radiated from the ultrasonic wave transmitter 501 is limited by the horn 503, but it is not possible to limit the direction of elastic waves reflected by the printing medium P. In addition, the direction of reflection changes as a result of inclinations in the surface that occur due to uplift of the printing medium, and there are cases in which elastic waves miss the ultrasonic wave receiver 502. Therefore, in order to improve reception sensitivity, within a range that does not scatter the elastic waves from the ultrasonic wave transmitter 501, it is desirable to install the ultrasonic wave receiver 502 in a position that is as close to the printing medium surface PS as possible.

Next, an operation to avoid contact between the carriage 36 and the printing medium P during operation in the printing apparatus 1 will be described. In a printing apparatus 1 that is configured in this manner, it is possible to measure the time of arrival from when elastic waves radiated from the ultrasonic wave transmitter 501 are reflected by the printing medium P to when the elastic waves arrive at the ultrasonic wave receiver 502 using the ultrasonic wave sensor 5, the time of arrival detection unit 46 and the time of arrival measurement unit 412. Since the measurement result reflects the distance between the printing medium P and the carriage 36, contact can be avoided if the carriage 36 is stopped before the distance reaches zero. More specifically, for example, it is possible to configure in the following manner.

Figure 4:
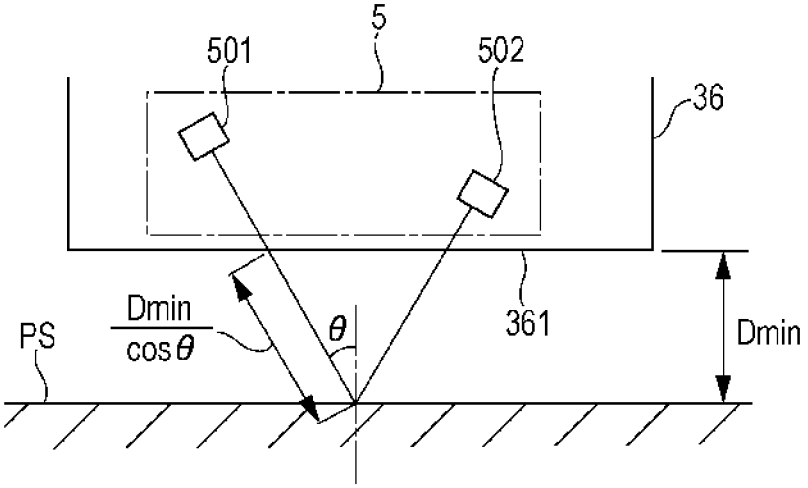
FIG. 4 is a view that shows a principle of contact avoidance in the embodiment.

FIG. 4 is a view that shows a principle of contact avoidance in the embodiment. When the printing medium P retains a normal orientation and is transported, the distance between a bottom surface 361 of the carriage 36 and the printing medium surface PS is a designed value that is established in advance. Meanwhile, when uplift of the printing medium P occurs, this distance becomes smaller, and the printing medium P comes into contact with the carriage 36 when the distance becomes zero. Therefore, the carriage control unit 411 may be configured to stop the carriage 36 when an allowable minimum distance Dmin between the distance of the designed value and zero in a case of normal transport is set in advance, and the distance between the carriage 36 and the printing medium surface PS falls below the allowable minimum distance Dmin.

Additionally, in the process, it is not necessary to calculate the actual distance between the carriage 36 and the printing medium surface PS. Since the positional relationship between the ultrasonic wave sensor 5 and the bottom surface 361 of the carriage 36 is fixed, it is possible to determine the time of arrival of the elastic waves when the printing medium surface PS has approached the allowable minimum distance Dmin from the length and the acoustic velocity of a pathway that is shown in FIG. 4 from the ultrasonic wave transmitter 501 after passing the printing medium surface PS and reaches the ultrasonic wave receiver 502. Further, the time of arrival at this time is established as a "defined time". When a measured time of arrival is shorter than the defined time, since this means that the distance between the carriage 36 and the printing medium surface PS falls below the allowable minimum distance Dmin, the carriage 36 may be stopped rapidly. Therefore, it is sufficient to compare the measured time of arrival and the defined time, and it is not necessary to convert this into distance. Additionally, this description was given using the positional relationship between the ultrasonic wave sensor 5 and the bottom surface 361 of the carriage 36, but since the positional relationship between the bottom surface 361 of the carriage 36 and the print head 32 is also fixed, it is possible to avoid contact between the print head 32 and the printing medium P by performing the abovementioned control. That is, the allowable minimum distance Dmin may be set using the distance between the print head 32 and the printing medium P, and the measured time of arrival of the elastic waves using a pathway from the ultrasonic wave transmitter 501 that reaches the ultrasonic wave receiver 502 after passing the printing medium surface PS may be compared with the defined time when a distance, which is obtained by adding a difference in the distance from the print head 32 to the printing medium P and the distance from the ultrasonic wave transmitter 501 to the printing medium P to the allowable minimum distance Dmin, is equivalent to a distance from the ultrasonic wave transmitter 501 to the printing medium P.

However, in order to make this possible, it is necessary to set the frequency of the elastic waves as appropriate. That is to say that, the distance between the carriage and the printing medium in this type of printing apparatus is normally set to a few millimeters, and the wavelength of the elastic waves that are used in elastic wave devices is also normally set to a similar extent. In other words, in order to achieve an objective of contact avoidance, a detection resolution of millimeters or submillimeters is necessary when converting into distance, and it is not possible to obtain such a resolution if the wavelength of the elastic waves is longer than this. Therefore, it is necessary to configure the allowable minimum distance Dmin to be greater than or equal to the detection resolution. In addition, in a case in which the allowable minimum distance Dmin is configured to be a predetermined value, it is necessary to set a wavelength at which the detection resolution is less than or predetermined to the desired value.

This will be described in more detail with reference to FIG. 4. From the relationship that is shown in FIG. 4, it is possible to express a length of the reciprocation pathway of the elastic waves that corresponds to distance using (2Dmin/cos θ) when the printing medium surface PS is in a position that is the allowable minimum distance Dmin from the carriage bottom surface 361. In order to discriminate between this length and zero, it is desirable that the wavelength of the elastic waves be less than or equal to half of this length. Since wavelength can be expressed using (Vs/Fs) when the frequency of the elastic waves is expressed using Fs and an acoustic velocity in air is expressed using Vs, the following relational expression is established, $$(Vs/Fs) \leq (2D\mathrm{min}/\cos\theta)/2$$

and the following expression is obtained if this is arranged with respect to frequency Fs.

$$Fs \geq (Vs \cdot \cos\theta)/D\mathrm{min} \qquad \text{Equation 1}$$

For example, if the allowable minimum distance Dmin is set to 1 mm, the acoustic velocity Vs is set to 340 m/s and θ is set to 30°, a preferable frequency Fs of the elastic waves is approximately 300 kHz or more.

However, in this embodiment, full-wave rectification wave detection is adopted in a detection unit 467 that detects the elastic waves, and in this case, a lower limit of the frequency of the elastic waves is half of that of the abovementioned Equation 1. That is, the following expression is established.

$$Fs \geq (Vs \cdot \cos\theta)/(2D\min) \quad \text{Equation 2}$$

The reason for this will be described next.

Figure 5A:
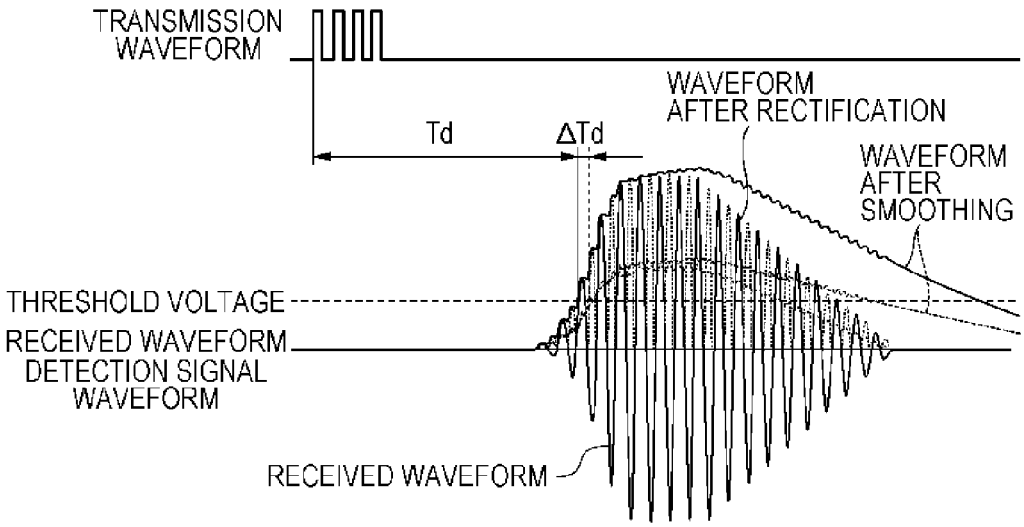
FIGS. 5A and 5B are diagrams that show relationships between wave detection methods and resolution.
Figure 5B:
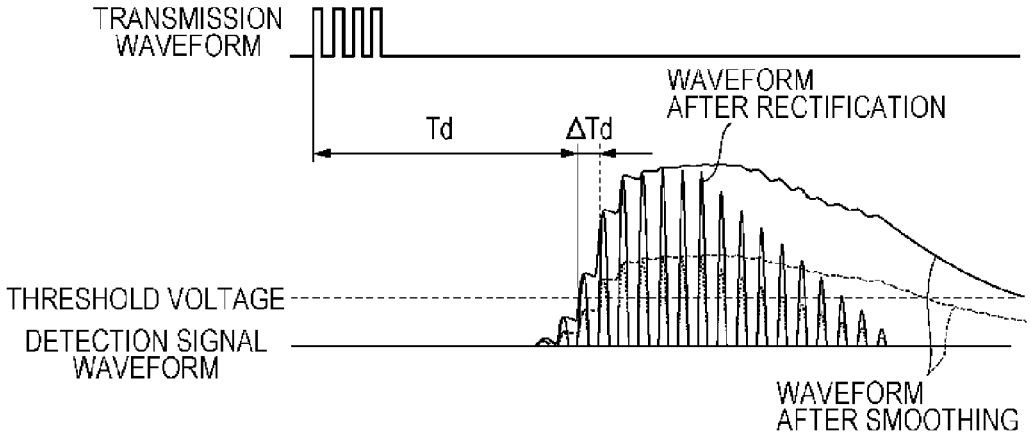

FIGS. 5A and 5B are drawings that show relationships between wave detection methods and resolution. In this case, FIG. 5A shows a full-wave rectification wave detection method that is used in the present embodiment, and FIG. 5B shows a half-wave rectification wave detection method that shows another example.

As shown in the upper portion of FIG. 5A, an ultrasonic wave signal that is transmitted from the ultrasonic wave transmitter 501 is for example, set as a 4-wave burst. Meanwhile, as shown in the lower portion of FIG. 5A, it is assumed that a signal that is output from the ultrasonic wave receiver 502 is formed of a more scattered waveform. The reason why the number of repetitions is greater than that of the transmitted signal is that reverberations and the like are included. A post-rectification waveform in which full-wave rectification has been performed on a received waveform becomes a form in which the waveform of the negative side is replicated on the positive side. Therefore, in the signal after rectification, the frequency visibly becomes twice that of the original signal.

In this manner, the detection unit 467 performs smoothing on a signal on which full-wave rectification has been performed and outputs the signal as a detection output. As a detection unit 467 that has this kind of function, for example, it is possible to use a well-known absolute value circuit with a hold function. A time constant τ of smoothing is set to be comparatively long, and is expressed with the following equation using the frequency Fs of the elastic waves and the circular constant π.

$$\tau \geq 1/(2\pi \cdot Fs) \quad \text{Equation 3}$$

More specifically, the time constant τ is set to between 1 and 3 times the right side of the abovementioned Equation 3. This is close to the conditions when operating an absolute value circuit as a peak hold circuit, and as shown as a "post-smoothing waveform" in FIG. 5A, in a waveform after smoothing, a peak value is held in phases in which the amplitude of the source waveform increases, an envelope curve is gentle, making it easy to detect changes in the waveform. Meanwhile, in phases in which the amplitude of the source waveform decreases, followability with respect to the source waveform is poor. That is, it is a condition that causes diagonal clipping distortion to be generated.

In this case, since the objective is to detect rises in a received signal, the ease of detection in phases in which the amplitude increases is more important, and it is effective to perform smoothing with conditions which causes this type of diagonal clipping distortion to be generated. Naturally, since it is not possible to follow rises in the signal if the time constant τ is too large, in the abovementioned manner, between 1 and 3 times the right side of the abovementioned Equation 3 is suitable.

A time from when the transmission of the elastic waves from the ultrasonic wave transmitter 501 begins, to when the voltage value of the rises in signals that are received by the ultrasonic wave receiver 502 and detected reach a predetermined threshold voltage is measured as the time of arrival Td. The threshold voltage can be determined as appropriate in consideration of the noise level of the measurement system or the like. Even if the time constant τ is sufficiently large, as shown with the symbol ΔTd in FIG. 5A, level changes in the envelope curve of phases with rises in amplitude only change at the pitch of the peak value of the amplitude after rectification. In addition, as the two types of post-smoothing waveform are shown with a solid line and a dotted line in the drawing, the measurement result of the time of arrival Td may be shifted forward or backward as a unit of a small amount of time ΔTd according to the signal level. That is, this value ΔTd is a resolution on a time axis. At this time, since full-wave rectification is used, the resolution ΔTd on the time axis becomes a reciprocal that is twice the frequency Fs of the source waveform. That is, the following equation is satisfied.

$$\Delta Td = 1/(2Fs) \quad \text{Equation 4}$$

Meanwhile, in the case of half-wave rectification that is shown in FIG. 5B, since the signal of the negative side is cut away, the change pitch of the peak value of the amplitude after rectification becomes a reciprocal of the frequency of the source waveform. That is, the resolution ΔTd on the time axis in this case is expressed using the following equation.

$$\Delta Td = 1/(Fs) \quad \text{Equation 5}$$

In this manner, as is clear from comparing Equation 4 and Equation 5, when the frequency of the elastic waves is the same, the resolution on the time axis in the full-wave rectification wave detection method is half that of the half-wave rectification wave detection method. That is, it is possible to detect more minute time differences as significant differences. In other words, the frequency of elastic waves needed to obtain the same resolution is half that of half-wave rectification. Since resolution on the time axis can be converted into resolution in spatial distance using acoustic velocity, it is possible to apply the same to resolution in the detection of distance.

Equation 1 that was mentioned above does not take this kind of replication due to full-wave rectification into account, and in a case in which a full-wave rectification wave detection method in used, and therefore the frequency of elastic waves needed to obtain the same resolution is half that of the case of Equation 1. That is, the relationship of Equation 2 is established. Therefore, the frequency of elastic waves that is used may be determined on the basis of the relational expression Equation 2 that is described above. With regard to examples of the dimensions mentioned above, it is preferable that the frequency Fs of the elastic waves be set as approximately 150 kHz or more.

The abovementioned theory stipulates a lower limit of the frequency of the elastic waves, but this does not necessarily mean that the frequency should be as high as possible. In the propagation of elastic waves through air, loss is great if the frequency is high, and if the distance to be detected is increased, the precision of detection decreases greatly. The detection target in this embodiment is a distance from a few millimeters to a few centimeters, and the upper limit of a frequency that can be used for this objective is approximately 1 MHz.

Additionally, in this embodiment, since propagation distance and time of arrival are mutually convertible through a value of acoustic velocity in air, movement control of the carriage 36 is performed directly from the measurement result of the time of arrival of the elastic waves. However, since the acoustic velocity in air changes depending on environmental values such as the temperature and humidity of the air, air pressure and the like, in addition to detecting these environmental values separately, it is preferable that that a measured time of arrival or defined time be compared after compensation using these environmental values. More simply, just a portion of these environmental values may be used.

In the abovementioned manner, in this embodiment, the ultrasonic wave sensor 5 is installed in the carriage 36 that forms an image while moving relatively with respect to a printing medium P, elastic waves are radiated toward the printing medium P, reflected waves are detected, and a time of arrival of the elastic waves is measured. Further, the movement of the carriage 36 is stopped rapidly when the measured time of arrival is shorter than a defined time that is established in advance. By configuring in this manner, the movement of the carriage 36 is stopped when the distance between the carriage bottom surface 361 and the printing medium surface PS falls below an allowable minimum distance Dmin that corresponds to a defined time, and contact between the carriage 36 and the printing medium P can be avoided. As a result of this configuration, staining of the device and the printing medium P are prevented. In addition, by setting the allowable minimum distance suitably, excessive contact avoidance, that is, inconvenient situations in which movement is stopped even though there is no danger of contact occurring, is avoided, and it is possible to achieve an improvement in the throughput of printing in addition to eliminating wasted printing.

In comparison with the related art that uses an optical detection method, the present embodiment, which achieves impact avoidance between the carriage 36 and the printing medium P by measuring the time of arrival of elastic waves that corresponds to the distance between the carriage 36 and the printing medium P using the reflections of elastic waves, has an advantage of obtaining the same effect in the case of a transparent printing medium P such as a resin film as that of an opaque printing medium P without being influenced by corrugation or the like and the state of the surface of the printing medium P.

However, in order to detect this kind of change over short distances, it is necessary to suitably set the frequency of the elastic waves that are used, and more specifically, a sufficient resolution that is necessary in order to do so can be obtained by satisfying the relationship of the abovementioned Equation 2.

In addition, in order to detect the radiated elastic waves effectively, in this embodiment, the horn 503 is attached to the ultrasonic wave transmitter 501, the radiation direction of the elastic waves is controlled, and the ultrasonic wave receiver 502 is disposed closer to the printing medium P.

In addition, in this embodiment, by acoustically insulating the ultrasonic wave transmitter 501 and the ultrasonic wave receiver 502 in the ultrasonic wave sensor 5, it is possible to detect reflected waves with high precision by controlling the throughput of elastic waves through the housing 51 and the like.

In addition, in this embodiment, by performing full-wave rectification on a received signal and performing smoothing with a smoothing circuit that has a large time constant, in addition to an improvement in detection precision being made by making it easier to perceive changes in the rises of the waveform, an improvement in the resolution of detection is made.

In the manner described above, in this embodiment, the print head 32 functions as the "printing unit" of the present invention, and the carriage 36 functions as the "carriage" of the present invention. In addition, in the abovementioned embodiment, while the ultrasonic wave transmitter 501 functions as the "elastic wave radiation unit" of the present invention, the ultrasonic wave receiver 502 functions as the "reception unit" of the present invention. In addition, the controller 4 functions as the "control unit" of the present invention. In addition, in the embodiment, the detection unit 467 of the time of arrival detection unit 46 functions as the "envelope curve wave detection unit" of the present invention.

Additionally, the present invention is not limited to the abovementioned present embodiment, and provided they do not depart from the scope thereof, it is possible to make various modifications other than those described above. For example, in the abovementioned embodiment, the ultrasonic wave sensor 5 is installed in the carriage 36, but this is not essential for the objective of preventing contact with the carriage by detecting uplift of the printing medium P. That is, since the distance from the carriage to the printing medium can be calculated if the positional relationship of the ultrasonic wave sensor and the carriage is known and the distance from the ultrasonic wave sensor to the printing medium is known, the carriage can even be stopped when the distance from the carriage to the printing medium becomes smaller than a defined value in a case in which the ultrasonic wave sensor is provided in a position other than the carriage.

In addition, in the abovementioned embodiment, the time of arrival of the elastic waves that are reflected by the printing medium is set as a stopping condition of the carriage, but the abovementioned distance between the carriage and the printing medium, and the time of arrival are mutually convertible physical quantities, and therefore performing determination using the time of arrival in the manner of the present embodiment and performing determination by determining distance are technically equivalent.

In addition, in the abovementioned embodiment, a signal received by the ultrasonic wave receiver 502 is processed by an analog circuit, but time of arrival may be determined by A/D converting the received signal from an analog signal into a digital signal and performing a digital operational treatment.

In addition, the abovementioned embodiment is an ink jet type printing apparatus that forms an image on a printing medium that moves in a sub-scanning direction by supplying ink droplets from a carriage while moving in a main scanning direction that is orthogonal to the sub-scanning direction, but the present invention is not dependent on printing method, and can be applied to printing apparatus of various printing methods.

The entire disclosure of Japanese Patent Application No. 2013-000373, filed Jan. 7, 2013 and 2013-268712, filed Dec. 26, 2013 are expressly incorporated by reference herein.

What is claimed is:

1. A printing apparatus comprising:

a printing unit that forms an image on a target printing surface of a printing medium by relatively moving with respect to the printing medium;

an elastic wave radiation unit that radiates elastic waves, which are pulses or burst waves in which a radiation direction is defined, toward the target printing surface;

a reception unit that receives the elastic waves that are radiated from the elastic wave radiation unit and reflected by the target printing surface; and a control unit which measures the time of arrival taken for elastic waves that are radiated from the elastic wave radiation unit to arrive at the reception unit, and stops relative movement when the time of arrival is shorter than a defined time, wherein the defined time is a time of arrival in which a distance that is obtained by adding a difference in the distance from the printing unit to the printing medium and the distance from the elastic wave radiation unit to the printing medium to an allowable minimum distance between the printing unit and the printing medium that is established in advance, is equivalent to a distance from the elastic wave radiation unit to the printing medium, wherein, in a pathway of the elastic waves from the elastic wave radiation unit to reach the reception unit after passing the target printing surface, the pathway length to the reception unit after passing the target printing surface is shorter than the pathway length to the target printing surface from the elastic wave radiation unit.

2. The printing apparatus according to claim 1, wherein, when an angle that is formed by a central axis of the radiation direction of the elastic waves from the elastic wave radiation unit, and a normal line of the target printing surface at an intersection point of the central axis and the target printing surface at the time of image formation, is expressed using the symbol 8, the allowable minimum distance is expressed using the symbol Dmin, and an acoustic velocity in air is expressed by the symbol Vs, a frequency Fs of the elastic waves satisfies the following formula:

$$Fs \geq (Vs \cdot \cos\theta)/(2D\min).$$

3. The printing apparatus according to claim 1, wherein the elastic wave radiation unit and the reception unit are acoustically insulated.

4. The printing apparatus according to claim 1 further comprising:

an envelope curve wave detection unit that outputs a signal that corresponds to an envelope curve of a waveform of a received elastic wave that is received by the reception unit, wherein the control unit sets a time from when the elastic wave radiation unit radiates elastic waves to when an output signal of the envelope curve wave detection unit reaches a predetermined threshold value as the time of arrival.

5. The printing apparatus according to claim 4, wherein envelope curve wave detection unit generates the signal through full-wave rectification and smoothing of the received elastic wave, and a time constant $\tau$ of smoothing has the following relationship with respect to the frequency Fs of the elastic waves:

$$\tau \geq 1/(2\pi \cdot Fs).$$

* * * * *